United States Patent [19]

Anneman

[11] 4,083,722

[45] Apr. 11, 1978

[54] DEVELOPER COMPOSITION AND PROCESS FOR DEVELOPING PHOTOGRAPHIC FILM

[76] Inventor: William Alexander Anneman, 10021 LaTuna Canyon Blvd., Sun Valley, Calif. 91352

[21] Appl. No.: 759,986

[22] Filed: Jan. 17, 1977

Related U.S. Application Data

[63] Continuation-in-part of Ser. No. 666,574, Mar. 15, 1976, abandoned.

[51] Int. Cl.[2] ..... G03C 5/30

[52] U.S. Cl. ..... 96/66 HD; 96/66.3

[58] Field of Search ..... 96/66 HD, 66.3

[56] References Cited

U.S. PATENT DOCUMENTS

| | | | |
|---|---|---|---|
| 2,289,367 | 7/1942 | Kendall | 96/66 HD |
| 3,687,669 | 8/1972 | Iijima et al. | 96/66.3 |
| 3,772,019 | 11/1973 | Holden et al. | 96/66 HD |
| 3,839,046 | 10/1974 | Gent | 96/66 HD |
| 3,865,591 | 2/1975 | Katz | 96/66 HD |
| 3,867,151 | 2/1975 | Katz | 96/66.3 |

*Primary Examiner*—Mary F. Kelley

*Attorney, Agent, or Firm*—Patrick F. Bright

[57] ABSTRACT

A composition useful as a developer for high-contrast, extremely fine and microfine grain silver halide-containing emulsions comprises at least one 3-pyrazolidone compound, at least one hydroxybenzene compound, and p-methylaminophenol sulfate, at least one accelerator and at least one alkaline preservative. This composition is a semi-compensating, low contrast, fine grain, developer for producing normal contrast photographic negatives from exposed film emulsions generally considered to be capable of reproducing only black or white with repression of almost all gray tones found in normal tone-graduated subjects.

15 Claims, No Drawings

DEVELOPER COMPOSITION AND PROCESS FOR DEVELOPING PHOTOGRAPHIC FILM

This application is a continuation-in-part of U.S. Ser. No. 666,574, filed Mar. 15, 1976, for DEVELOPER COMPOSITION AND PROCESS FOR DEVELOPING PHOTOGRAPHIC FILM now abandoned.

This invention relates to a composition especially useful as a developer for photographic film, and to a process for developing exposed photographic film carrying an extremely fine- and/or microfine-grain silver halide emulsion.

Known developer compositions for high contrast, extremely fine-grain films have been made from such known reducers as hydroquinone, mono-p-methylparaminophenol sulfate (Elon, Metol), pyrogallol (1,2,3-hydroxybenzene), Amidol (2,4-diaminophenol) and p-phenylenediamine together with alkalis to adjust the pH, preservatives such as sodium sulfite to prevent degradation of the composition by oxygen, antifoggants such as potassium bromide and various other additives for toning and the like. See, for example, U.S. Pat. Nos. 2,448,857; 2,614,927; 2,710,257; 2,757,091; 3,088,824; 3,132,943; 3,356,502; and 3,722,019. Other patents of interest include U.S. Pat. Nos. 2,289,367; 3,632,341; and 3,715,214, and the references cited in these patents.

One formulation for development of a low speed film, found in U.S. Pat. No. 2,710,257, is composed of a major portion of hydroquinone and minor portions of Metol, sodium hydroxide, sodium sulfite, potassium bromide, and other additives. Unfortunately, such compositions do not produce photographic negatives having the combined advantages of very high resolving power; spectral sensitivity response comparable to that of the human eye; and the capability of recording with sharp definition the full range of gray tones within a contrast range compatible with normal photographic printing paper characteristics.

It is an object of this invention to provide a specifically formulated low contrast photographic film developer that produces normal contrast negatives from high contrast films.

Another object of the invention is to produce negatives from high contrast black and white photographic film comprising extremely fine-grain silver halide emulsions that have good definition, which is a combination of extremely fine-grain, very high resolving power (between 130 and 300 linear lines per millimeter), and well defined edge sharpness between areas of differing densities.

Another object of the invention is to provide a developer for high contrast panchromatic black and white film comprising extremely fine-grain silver halide emulsions to produce negatives with density range contrast index value and spectral sensitivity that will faithfully, definitively record colors in tones of gray as seen by the human eye.

This invention provides a composition of matter especially useful as a developer composition comprising at least one 3-pyrazolidone compound, at least hydroxybenzene compound and p-methylaminophenol or an acid salt thereof, for example, the preferred sulfate salt, at least one accelerator, and at least one alkaline preservative.

The weight ratio of said at least one 3-pyrazolidone compound to the hydroxybenzene compound or compounds is in the range of about 3:1 to about 8:1. P-methylaminophenol or a salt thereof, (referred to hereafter individually and collectively as "the sulfate") may be present in amounts of about 0.25 grams per liter of developer to about 4 grams per liter of developer, with the amount of this sulfate depending on the quantity of the 3-pyrazolidone compound present. Thus, as the quantity of the 3-pyrazolidone compound in the developer composition decreases, the amount of the sulfate increases. However, because the 3-pyrazolidone compound is a more active developer than the sulfate, decreasing the quantity of the 3-pyrazolidone compound requires increasing the amount of the sulfate in a weight ratio that is greater than 1 to 1. Thus, for example, if the developer composition contains as little as one gram of the 3-pyrazolidone compound, the composition should contain about 4 grams of the sulfate; by contrast, if the 3-pyrazolidone compound constitutes 2 grams per liter of the developer, the sulfate may be reduced to an amount of about 0.25 grams per liter of developer.

Preferably, alkaline preservatives are selected from the group consisting of alkali metal sulfites and alkali metal bisulfites. More preferably, the preservative is an alkali metal sulfite, most preferably, sodium sulfite.

The composition of this invention also comprises at least one accelerator. Typical accelerators are alkali metal, e.g. sodium, carbonate, alkali metal, e.g. sodium, metaborate, alkali metal, e.g. sodium, hydroxide and borax. The amount of accelerator present varies depending on the nature and quantity of the 3-pyrazolidone compound or compounds present, the quantity of benzene compound or compounds present and the nature and quantity of the preservative. However, the accelerator is preferably present in an amount of about 0.25 grams per liter to about 2 grams per liter, more preferably in an amount of about 0.5 gram to about 1.0 gram per liter of developer.

The hydroxybenzene compounds useful in the composition of this invention may contain one or more hydroxy groups. Examples of suitable monohydroxybenzene compounds are N-methyl-para-aminophenol and N-methyl-para-aminophenol sulfate. Especially preferred are the dihydroxybenzene compounds, and particularly the para-dihydroxybenzene compounds, such as hydroquinone, which is particularly preferred, and the substituted para-dihydroxybenzene compounds such as the substituted hydroquinones. Examples of substituted hydroquinones are alkyl-substituted hydroquinones, aryl-substituted hydroquinones, and other hydrocarbon-substituted hydroquinones, carboxyl-substituted hydroquinones, acyl-substituted hydroquinones, acyloxy-substituted hydroquinones, alkoxy-substituted hydroquinones, and halo-substituted hydroquinones. Other less suitable dihydroxybenzene compounds are catechol and catechols substituted with the sibstituents referred to in connection with hydroquinone. Trihydroxybenzene compounds, which term includes substituted trihydroxybenzene compounds, may also be used. An example of a trihydroxybenzene compound is pyrogallol; substituted pryogallols may also be used.

The 3-pyrazolidone compounds useful in the composition of this invention have the general formula

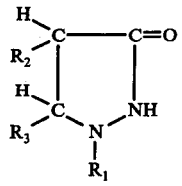

where $R_1$, $R_2$ and $R_3$ are the same or different and are hydrogen atoms or hydrocarbon groups such as alkyl groups, e.g. methyl, ethyl, propyl, isopropyl, or higher alkyl groups, aryl groups, e.g. phenyl and naphthyl groups or aralkyl groups, e.g. benzyl groups. Such hydrocarbon substituents may themselves be substituted; for example, aryl groups may be substituted with hydroxy, alkoxy, oxyalkyl, amino, substituted amino, nitro, sulphonic or carboxylic groups or halogen atoms. Specific 3-pyrazolidone compounds include 1-phenyl-3-pyrazolidone, which is especially preferred, 1-p-tolyl-3-pyrazolidone, 5-phenyl-3-pyrazolidone, 1-p-chlorophenyl-3-pyrazolidone, 1-m-tolyl-3-pyrazolidone, 1-phenyl-5-methyl-3-pyrazolidone, 1-p-tolyl-5-phenyl-3-pyrazolidone, 1-p-methoxyphenyl-3pyrazolidone, 1-acetamidophenyl-3-pyrazolidone, 1-m-aminophenyl 4-methyl-4-propyl-3-pyrazolidone, 1,3-acetamidophenyl-4,4-diethyl-3-pyrazolidone, and 1-p-tolyl-4,4-dimethyl-3-pyrazolidone. These pyrazolidones may be present in an amount of about 1.0 to about 2.0 grams per liter of developer.

The alkaline preservative in this new composition is preferably an alkali metal sulfite or an alkali metal bisulfite, but may be a combination of one or more of each. Especially preferred are the alkali metal sulfites such as sodium sulfite and potassium sulfite. Preservative is present in an amount sufficient to produce a strongly alkaline composition, preferably having a pH of about 9 or more. Such amounts may be in the range of about 20 to about 40 grams per liter of developer, more preferably in the range of about 25 to about 35 grams per liter. In a preferred embodiment, sodium sulfite is present in amounts of about 25 grams per liter to about 30 grams per liter.

These new compositions typically contain no restrainer and no other known developer ingredients of any kind besides those described above. Thus, they are easy to make and replicate, and reliably produce the same excellent developing results time after time.

The compositions of this invention may be made by mixing the ingredients of the composition in any desired order. However, commonly the 3-pyrazolidone compound, hydroxybenzene compound, p-methylaminophenol sulfate, preservative, and accelerator, if any, are mixed in any desired order; the resulting mixture is then dissolved in water. Alternatively, two or more of the ingredients may be added to water, and the other ingredients thereafter added alone or in combination with one another.

The composition of this invention is especially useful as a developer for photographic film, and particularly for black and white high contrast photographic film comprising extremely fine-grain, silver halide emulsions. Examples of such film are Eastman Kodak High Contrast Copy film, Agfa Gevaert Microfilm (also known as H & W VTE Ultra), Eastman Kodak S0410 Photomicrography film, and Agfa Gevaert Copex copy film (also known as H & W VTE Pan). Films of these kinds typically have a low ASA rating in the range of about ASA 6 to about ASA 100.

Using this developer composition to develop exposed photographic films of these kinds, negatives can be made that have high resolving power in the order of 90 to 150 lines per millimeter, exceptional sharpness, excellent definition, and a density range and contrast ratio suitable for photographic enlargement on normal contrast photographic printing papers. Negatives made in the developer of this invention accurately and definitively reproduce the full scale of gray tones between black and white. Properly formulated, the developer composition of this invention can produce these results in a development time in the range of about six minutes to about twelve minutes where the temperature of the developer is in the range of about 68° to about 72° Farenheit (F.).

The developer composition of this invention is also ideal for developing extremely fine-grain films such as Ilford Pan F, Kodak Panatomic X, and Dupont ADOX KB 14. Although these films are rated between ASA 25 and ASA 40, with the new developer of this invention exposures may be made at an exposure index (E.I.) of 400 (3 to 4 stops underexposed). Yet, upon development, these films, in 35-millimeter size, will produce negatives that can make enlarged prints 11 by 14 inches in size with exceptional quality. When used to develop these films, developing time ranges from 8 to 20 minutes, more commonly from 10 to 15 minutes, provided the developer temperature is in the range of about 70° to about 80° F.

The developer compositions of this invention may also be used to develop high speed films such as ASA 400 Kodak Tri-X with exposures being made at an E.I. of 4000 (3 to 4 stops underexposed). Even at these speeds, a Tri-X negative will enlarge on grade 2 paper with wide tonal range, and good resolution. Typically, to develop 35-millimeter Tri-X film with the developer of this composition, developing time will range from 10 to 15 minutes, more commonly about 12 minutes, at temperatures in the range of about 85° to about 100° F., more commonly about 95° F.

EXAMPLE

Using a Nikon 55 Millimeter Micro camera and 35 millimeter Eastman Kodak High Contrast Copy film, two groups containing 36 exposures each were made at each of the following speeds: ASA 12, ASA 25, and ASA 50. All exposures were made at a lens opening of f/11, and all were made outdoors on a bright, sunny day. Each exposure included brightly lit areas, areas including varying degrees of shadow detail, a number of signs bearing printed material of various sizes and colors and clear, blue sky in the background to examine and evaluate film grain. The two groups were developed in developers containing the following compositions:

| | GRAMS PER LITER | |
|---|---|---|
| INGREDIENT | A | B |
| 1-phenyl-3-pyrazolidone | 1.50 | 1.75 |
| hydroquinone | 0.50 | 0.25 |
| p-methylaminophenolsulfate | 0.25 | 0.25 |
| sodium sulfite | 30.00 | 30.00 |
| borax | 0.75 | 0.50 |
| water (distilled) | to make 1 liter | to make 1 liter |

The ASA 25 exposures exhibited resolving power in the order of 90 to 200 linear lines per millimeter, an extremely high degree of sharpness, and the full scale of well-defined gray tones from absolute white to complete black. All colors were recorded in an appropriate shade of gray and were accurately reproduced. A contrast ratio was obtained which enabled prints to be made on Grade No. 2 enlarging paper. Grain was undetectable in prints enlarged to 8 by 10 inches in size. No sacrifice in quality was observed in prints measuring 20 by 30 inches, which represents magnification of approximately 20 times the original negative size. Similar results were obtained from negatives made from exposures at ASA 12 except for a slight loss on the highlight end of the gray scale and a one paper grade increase in contrast. Negatives made at ASA 50 exhibited a slight loss of shadow area detail and a one paper grade decrease in contrast.

What is claimed is:

1. A bromide free developing composition consisting essentially of at least one 3-pyrazolidone compound, at least one hydroxybenzene compound selected from the group consisting of ortho-dihydroxybenzene compounds, para-dihydroxybenzene compounds, substituted ortho-dihydroxybenzene compounds, substituted para-dihydroxybenzene compounds, trihydroxybenzene compounds, and substituted trihydroxybenzene compounds, para-methylaminophenol or an acid salt thereof, at least one alkaline preservative and at least one accelerator wherein the weight ratio of said at least one 3-pyrazolidone compound to said at least one hydroxybenzene compound is in the range of about 3:1 to about 8:1.

2. The composition of claim 1 wherein said at least one 3-pyrazolidone compound constitutes an amount in the range of about 1 to about 2 grams where said composition is made up to a liter with water.

3. The composition of claim 2 wherein said at least one hydroxybenzene compound constitutes an amount in the range of about 0.25 to about 1.5 grams where said composition is made up to a liter with water.

4. The composition of claim 3 wherein said paramethylaminophenol sulfate constitutes an amount in the range of about 0.25 grams to about 4 grams where said composition is made up to a liter with water.

5. The composition of claim 4 wherein said preservative constitutes an amount in the range of about 20 to about 40 grams where said composition is made up to a liter with water.

6. The composition of claim 5 wherein said accelerator constitutes an amount in the range of about 0.25 to about 2 grams where said composition is made up to a liter with water.

7. The composition of claim 1 wherein the composition consists essentially of one 3-pyrazolidone compound, and one hydroxybenzene compound.

8. The composition of claim 7 wherein the alkaline preservative is selected from the group consisting of alkali metal sulfites and alkali metal bisulfites.

9. The composition of claim 8 wherein the alkaline preservative is an alkali metal sulfite.

10. The composition of claim 9 wherein the alkaline preservative is sodium sulfite.

11. The composition of claim 10 wherein the 3-pyrazolidone compound is 1-phenyl-3-pyrazolidone and the hydroxybenzene compound is hydroquinone.

12. The composition of claim 8 wherein the accelerator is borax.

13. The composition of claim 12 comprising: 1.50 grams 1-phenyl-3-pyrazolidone; 0.50 gram hydroquinone; 0.25 gram p-methylaminophenol sulfate; 30 grams sodium sulfite; 0.75 gram borax, and sufficient water to make one liter.

14. The composition of claim 7 wherein the 3-pyrazolidone compound is 1-phenyl-3-pyrazolidone, the hydroxybenzene compound is hydroquinone, the alkaline preservative is an alkali metal sulfite, and the accelerator is borax.

15. The composition of claim 12 comprising: 1.75 grams 1-phenyl-3-pyrazolidone; 0.25 gram hydroquinone, 0.25 gram p-methylaminophenol sulfate; 30.00 grams sodium sulfite; 0.50 gram borax, and sufficient water to make one liter.

* * * * *